US005181706A

United States Patent [19]

Yamamoto et al.

[11] Patent Number: 5,181,706

[45] Date of Patent: Jan. 26, 1993

[54] SHEET FEEDING APPARATUS THAT USES A VARIABLE VACUUM SURFACE AND TIMER TO ACHIEVE A DUPLICATE FEED PREVENTIVE FUNCTION

[75] Inventors: Hiranaga Yamamoto, Yamatokooriyama; Souichi Takata, Shiki; Osamu Wakuda, Yamatotakada; Toyoaki Namba, Nara, all of Japan

[73] Assignee: Sharp Kabushiki Kaisha, Osaka, Japan

[21] Appl. No.: 672,652

[22] Filed: Mar. 20, 1991

[30] Foreign Application Priority Data

Mar. 20, 1990 [JP] Japan ..... 2-70916

[51] Int. Cl.[5] ..... B65H 5/08; B65H 3/08; B65H 3/34

[52] U.S. Cl. ..... 271/11; 271/96; 271/98; 271/99; 271/104; 271/171

[58] Field of Search ..... 271/94, 96, 98, 99, 271/104, 5, 11, 12, 165, 171

[56] References Cited

U.S. PATENT DOCUMENTS 4,219,191 8/1980 Rastorguyeff ..... 271/94
4,362,380 12/1982 Dragstedt .
4,469,319 9/1984 Robb et al. ..... 271/171
4,550,903 11/1985 Moore .
4,627,606 12/1986 Moore ..... 271/98

FOREIGN PATENT DOCUMENTS 82537 5/1985 Japan ..... 271/165
88734 4/1987 Japan ..... 271/99
88735 4/1987 Japan ..... 271/99
282029 11/1988 Japan ..... 271/171

*Primary Examiner*—Robert P. Olszewski
*Assistant Examiner*—Steven M. Reiss
*Attorney, Agent, or Firm*—David G. Conlin; Donald R. Castle

[57] ABSTRACT

When stacking up recording papers on a tray and conveying one by one from the top or bottom, they are conveyed by attracting in vacuum to a conveying belt. An example of conveying from the bottom is illustrated. When one recording paper is conveyed, its rear end comes into the attraction region of the conveying belt, and the second recording paper is attracted into the region out of the first recording paper in the attraction region, which results in duplicate feed. Therefore, the size of the attraction region is variable depending on the size of the recording paper so that the attraction region of the conveying belt may not come out from the rear end of the recording paper until the first recording paper is conveyed and its front end is held by the rear rollers of the conveying belt or the like.

8 Claims, 17 Drawing Sheets

FIG. 1 (1)
PRIOR ART
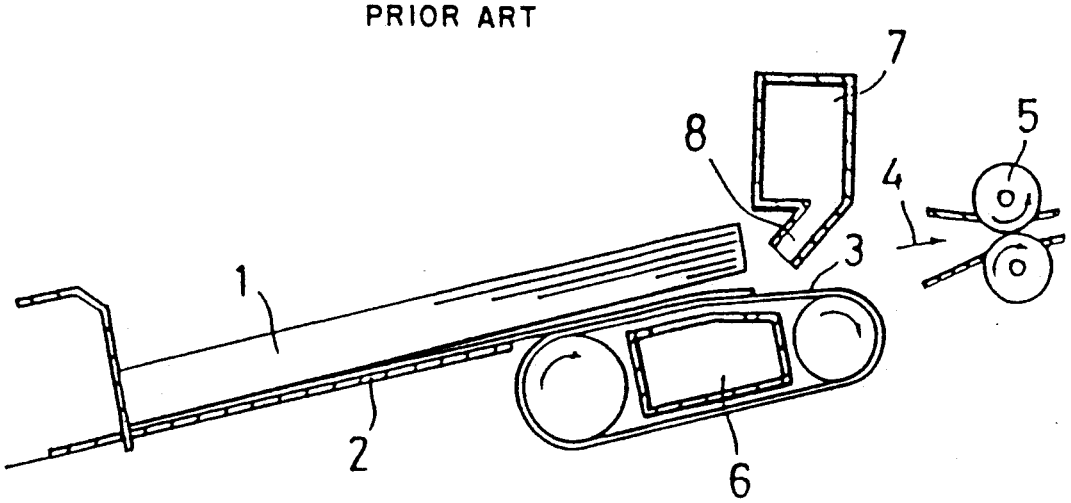
FIG. 1(2)
PRIOR ART
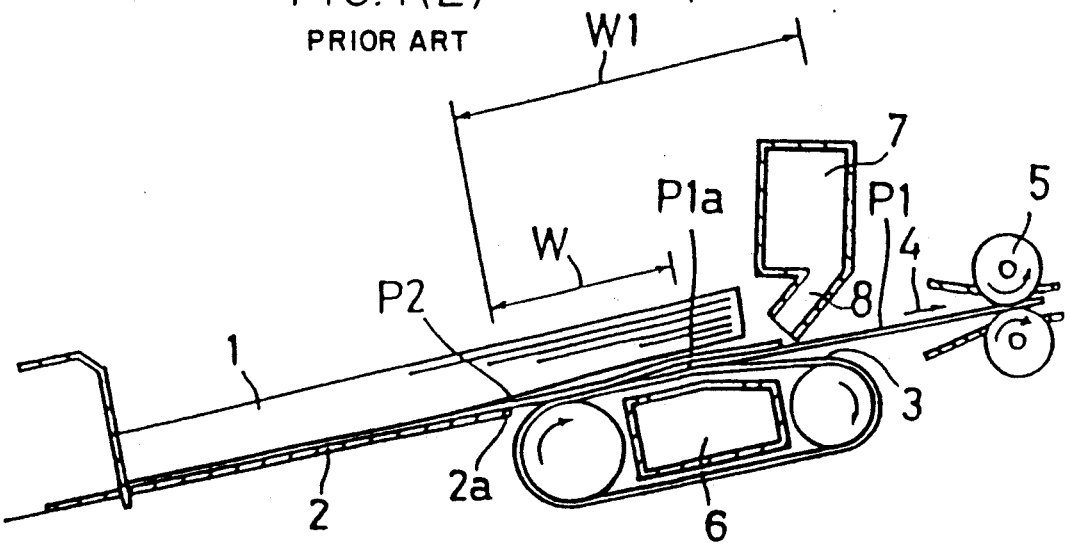

SHEET FEEDING APPARATUS THAT USES A VARIABLE VACUUM SURFACE AND TIMER TO ACHIEVE A DUPLICATE FEED PREVENTIVE FUNCTION

BACKGROUND OF THE INVENTION

1. Field of the Invention

The present invention relates to a sheet feeding apparatus with duplicate feed preventive function capable of feeding sheets such as recording paper in copying machine or printer one by one.

2. Description of the Prior Art

Typical prior art is shown in FIG. 1 (1) and FIG. 1 (2). In FIG. 1 (1), recording papers 1 in a copying machine are stacked up on a laying plate 2, and the bottom sheet of these sheets is attracted in vacuum to a paper feeding stretch belt 3, and is fed in the paper feed direction 4 to be held by a pair of feed rollers 5, and is further conveyed. The belt 3 has multiple air passage holes, and the vacuum attraction box 6 is in negative pressure, so that the bottom recording paper of the stack of recording papers is attracted in vacuum to the belt 3 as mentioned above. The bottom recording sheet and the second and other sheets are separately vertically by the air flow injected from nozzle holes 8 in air flow forming means 7, so that the recording papers are fed one by one. The recording paper attracted in vacuum and fed by the belt 3 is held by the rollers 5 and conveyed, then the rotation of the belt 3 is stopped, and the sheet is fed only by the function of the rollers 5.

In such prior art, in the initial state shown in FIG. 1 (1), the belt 3 is rotated and driven, and the bottom recording paper is fed in the feed direction 4, and then, as shown in FIG. 1 (2), the bottom sheet indicated by reference number P1 is held by the rollers 5 and is conveyed, when the belt 3 is stopped as mentioned above. While this being 3 is being rotated and driven, if a gap W is produced between the end part of the upstream side of the stopping direction of the bottom recording paper P1 (that is, the rear end part) P1*a*, and the end part 2*a* at the downstream side of the stopping direction 4 of the laying plate 2 disposed at the fixed position, the second sheet P2 from the bottom is attracted to contact with the belt 3 at the gap W, and is fed in the feed direction, together with the bottom recording paper P1. The feed effective length W1 working for feed of recording paper by the belt 3 exposed at the downstream side in the feed direction from the end part 2*a* of the laying plate 2 must be enough to obtain a large conveying force required for the recording paper of large size and large weight, and is hence determined by the distance between the belt and rollers 5 in the feed direction and the minimum length of the recording paper 1.

In the prior art, since such feed effective length W1 is fixed, if the feed effective length W1 is set long in consideration of feeding of recording paper of large size and large weight, when feeding recording paper of small size, the second recording paper P2 is attracted to the portion W not covered by the bottom recording paper P1 in the range of the feed effective length W1 of the belt 3 before the recording paper begins to be fed by the rollers 5, and duplicate feed of recording papers occurs, or the second recording paper is slightly fed in the feed direction 4, and when feeding the next recording paper in this state, the recording papers are not separately securely in the vertical direction by the air injected from the nozzle holes 8, so that duplicate feed occurs, too.

To the contrary, if the feed effective length W1 of the belt 3 is set short in consideration of feeding of recording paper of small size, the conveying force for feeding recording paper of large size and large weight is insufficient, and feeding failure of recording paper of large size and large weight occurs. Hence, in the prior art, the size of the sheets that can be fed is limited.

SUMMARY OF THE INVENTION

It is hence a primary object of the invention to present a sheet feeding apparatus with duplicate feed preventive function capable of feeding sheets in various sizes one by one while preventing duplicate feed.

To achieve the above object, the invention presents a sheet feeding apparatus with duplicate feed preventive function comprising:

(a) a laying plate on which plural sheets are stacked up, (b) first feeding means composed of feeding stretch belt for feeding sheets on the laying plate, extending along the feed direction, and means for driving the belt.

(c) second feeding means disposed at the downstream side in the feed direction of the first feeding means for further feeding the sheets from the first feeding means, (d) stopping means for stopping the driving means of the first feeding means, in relation to feed of sheets by the second feeding means, and (e) a cover member for covering the region at the upstream side in the feed direction of the feeding surface of the belt of the first feeding means so as to be able to adjust the length of the region in the feed direction, wherein (f) feed of next sheet by feeding stretch belt is prevented.

According to the invention, a notch is formed in the end part at the downstream side of feeding direction of the laying plate, and this notch is opposite to the first feeding means for feeding the bottom sheets of the stacked-up sheets.

Also according to the invention, the first feeding means has multiple air passage holes formed in the feeding stretch belt and, a vacuum attraction box opened upward is disposed immediately beneath the nearly horizontal upper stretching part of the belt, being located beneath the sheets on the laying plate.

Moreover, according to the invention, the feeding means has multiple air passage holes formed in the feeding stretch belt, a vacuum attraction box opened downward is disposed immediately beneath the nearly horizontal lower stretching part of the belt, and the first feeding means is located above the sheets on the laying plate.

In the invention, air flow forming means for injecting an air flow toward the feeding direction and toward the vicinity of the end part of stacked-up sheets is disposed at the downstream side in the feeding direction of the laying plate, and the bottom or top sheet to be fed on the laying plate, and the remaining sheets are separated vertically by this air flow.

Also in the invention, sheet detecting means for detecting the sheets fed by the second feeding means is disposed at the downstream side of the second feeding means, and the stopping means is to stop the driving means of the first feeding means, in response to the output of the sheet detecting means.

Also according to the invention, the distance W2 between the end part of the downstream side in the feeding direction of the cover member and the sheet detecting means in the feeding route is decided at not more than the length of the sheets to be fed.

In the invention, a timer for clocking the predetermined time from start of feeding of sheet by the first feeding means till end of feeding of the same sheet by the second feeding means is provided, and the stopping means stops the driving means of the first feeding means, in response to the output of the timer.

According to the invention, the constitution also includes driving means for cover member for driving the cover member by reciprocal displacement along the feeding means.

means for determining the size of sheet to be fed, and control means for activating the driving means for the cover member in response to the output of the size determining means, and setting the position in the feeding direction of the cover member so that the next sheet may not be fed by the first feeding means while the bottom or top sheet of the stack of sheets is being fed by the first feeding means.

In the invention, still more, a rear end defining member for aligning the end parts of the stacked-up sheets at the upstream side of the feeding direction is disposed reciprocally in the feeding direction, and this rear end defining member is fixed on the cover member.

In the invention, the second feeding means possesses a pair of rollers for holding and feeding sheets.

The invention also presents a sheet feeding apparatus with duplicate feed preventive function comprising:

(a) a laying plate on which plural sheets are stacked up, (b) first feeding means composed of feeding stretch belt for feeding sheets on the laying plate, extending along the feed direction, and means for driving the belt, (c) second feeding means disposed at the downstream side in the feed direction of the first feeding means for further feeding the sheets from the first feeding means, (d) stopping means for stopping the driving means of the first feeding means, in relation to feed of sheets by the second feeding means, and (e) means for adjusting the length in the feed direction of a region at the downstream side in the feed direction of the feed surface of the belt of the first feeding means, wherein (f) feeding of next sheet by the feeding stretch belt is prevented.

According to the invention, plural sheets are stacked up on the laying plate, and the top or bottom sheet of the stacked-up sheets is fed by the feeding stretch belt of the first feeding means, and the sheet is further fed by the second feeding means disposed at the downstream side of the first feeding means, and while the single sheet is being fed by the second feeding means, the driving means for driving the belt is stopped, so that the sheet is conveyed only by the second feeding means. Therefore, in this stopped state of the belt of the first feeding means, the single sheet is fed by the second feeding means, and if a gap is produced between the end part of the downstream side of the feeding direction of the cover member for covering the region of the upstream side of the feeding direction of the belt feeding surface and the end part of the upstream side of the feeding direction of the sheet being fed by the second feeding means, in the feeding direction, the second sheet from the bottom will not be fed. Instead of the cover member, other means may be used also similarly.

The cover member covers the region at the upstream side of the feeding direction of the feeding surface of the belt so as to be capable of adjusting the length of the region in the feeding direction, and therefore while the bottom or top sheet is being fed by the drive of the belt of the first feeding means, it is possible to prevent from forming a gap in the feeding direction between the end part of the downstream side in the feeding direction of the cover member and the end part of the upstream side in the feeding direction of the bottom or top sheet being fed presently. As a result, feeding of the next sheet by the belt is prevented. Thus, the sheets different in the length in the feeding direction, namely in various sizes, may be securely fed one by one, and duplicate feed may be prevented.

Moreover, according to the invention, the first feeding means is opposite to the notch formed in the end part of the downstream side in the feeding direction of the laying plate, and hence stacked-up sheets may be fed one by one from the bottom. Such first feeding means for feeding the bottom sheet has a vacuum attraction box opened upward disposed immediately beneath the nearly horizontal upper stretching part of the belt having multiple air passage holes, so that the bottom sheet may be tightly attracted in vacuum to the belt.

In the invention, the first feeding means is located above the sheets stacked up on the laying plate, and in this case the first feeding means has a vacuum attraction box opened downward disposed immediately above the nearly horizontal lower stretching part of the belt possessing multiple air passage holes, so that the top one of the stacked-up sheets may be tightly attracted in vacuum and fed.

Again, in the invention, air flow forming means for feeding the sheets one by one securely to prevent duplicate feed perfectly is disposed, and this air flow forming means injects an air flow toward the first feeding means and toward the vicinity of the end part of the stacked-up sheets or the end of the downstream side in the feeding direction, and the bottom or top sheet to be fed on the laying plate and the second and other sheets are separated vertically by this air flow. As a result, single sheet feeding by the first feeding means is realized more securely.

Further according to the invention, the sheet fed by the first feeding means is further fed by the second feeding means disposed at its downstream side, and the sheet fed by the second feeding means is detected by sheet detecting means, and when the sheet fed by the second feeding means is detected by this sheet detecting means, the driving means of the first feeding means is stopped, and the belt is stopped. As a result, if a gap is produced between the end part at the downstream side in the feeding direction of the cover member and the end part of the upstream side in the feeding direction of the sheet fed by the first feeding means to bring the next sheet in contact with the belt, since the belt is stopped, the next sheet contacting with the belt will not be fed on.

In the invention, the distance in the feeding route between the end part at the downstream side in the stopping direction of the cover member and the sheet detecting means for detecting the sheet fed by the second feeding means is determined at not more than the length of the sheet to be fed. Therefore, when the sheet is detected by the sheet detecting means, the end part at the upstream side in the feeding direction of that sheet is either overlapped with the end part at the downstream side in the feeding direction of the cover member, or in the same position, and therefore by stopping the driving means of the first feeding means in this state to stop the belt, if the sheet is further fed by the second feeding means to produce a gap between the end part at the downstream side in the feeding direction of the cover member and the end part at the upstream side in the feeding direction of the sheet being fed, and the next sheet contacts with the belt of the first feeding means, since the belt is stopped, the next sheet is not fed on.

Again, in the invention, instead of detecting the sheet fed by the second feeding means by the sheet detecting means, the present time from the start of feed of sheet by the first feeding means till end of feed of the same sheet by the second feeding means is clocked by a timer, and the stopping means stops, in response to the timer output, the driving means of the first feeding means and stops the belt in the state of feeding of sheet by the second feeding means.

Moreover, in the invention, the size of the sheet fed by the first and second feeding means, that is, the length in the feeding direction is determined by the size determining means, thereby dislocating before and after the feeding direction of the cover member by the cover member driving means, and hence the belt of the first feeding means is driven, and the next sheet is prevented from being fed by the belt of the first feeding means while the belt of the first feeding means is driven to feed the sheet.

According to the invention, furthermore, there is a rear end defining member for aligning the end parts of the sheets stacked up on the laying plate at the upstream side in the feeding direction, that is, the rear ends, and the cover member is fixed to the rear end defining member, and therefore by dislocating the rear end defining member forward and backward in the feeding direction, the cover member may cover the region at the upstream side in the feeding direction of the feeding surface of the belt of the first feeding means, thereby achieving the duplicate feed preventive function automatically. Hence, it is possible to feed sheets of various size, differing in the length in the feeding length, may be securely fed one by one.

According further to the invention, the constitution may be simplified by aligning the end parts at the upstream side in the feeding direction of the sheets stacked up on the laying plate by the rear end defining member, and fixing the cover member to the rear end defining member. Incidentally, the second feeding means may be simplified so as to be composed of a pair of rollers, so that the constitution may be simplified.

The belt used in the first feeding means may be designed to attract in vacuum as described herein, but in other embodiment, it may be also possible to form multine fine undulations on the outer circumference of the belt so that the friction coefficient against the sheets to be fed may be increased, so that the vacuum attraction box may not be required, which also contributes to downsizing of the constitution.

Thus, according to the invention, by feeding the bottom or top sheet of the plural sheets stacked up on the laying plate by the feeding stretch belt of the first feeding means, and covering the region at the upstream side in the feeding direction of the feeding surface of the belt by the cover member so that the length of the region in the feeding direction may be adjustable, when the sheet from the first feeding means is further fed by the second feeding means located at the downstream side of the first feeding means, the driving means of the first feeding means is stopped by the stopping means to stop the belt, and therefore if a gap is produced between the end part at the downstream side in the feeding direction of the cover member and the end part at the upstream side in the feeding direction of the sheet fed by the second feeding means to bring the next sheet in contact with the belt of the first feeding means, the next sheet will not be sent forward, and only a single sheet is securely fed, and duplicate feed is prevented.

In the invention, meanwhile, the first feeding means is opposite to the notch formed at the end part at the downstream side in the feeding direction of the laying plate, and only the bottom sheet of the sheets stacked up on the laying plate can be fed, and such first feeding means comprises the feeding stretch belt possessing multiple air passage holes, and the vacuum attraction box opened upward immediately beneath the nearly horizontal upper stretching part of the belt, and is capable of sucking in vacuum the bottom sheet of the stacked-up sheets to the upper stretching part, and feeding it.

By the invention, in order to achieve the duplicate feed preventive function securely, the air flow from the air flow forming means is injected toward the first feeding means and near the end of the stacked-up sheets, and the bottom or top sheet to be fed and the second and other sheets of the stack are separated vertically by the air, so that only one of the stacked sheets may be securely fed by the first feeding means.

Also by the invention, sheet detecting means is disposed at the downstream side of the second feeding means, and when a sheet is detected by the sheet detecting means, the driving means of the first feeding means is stopped to stop the belt, thereby preventing the next sheet from being fed by the belt of the first feeding means when the sheet is fed by the second feeding means.

Moreover, by the invention, the distance in the feeding route between the end part at the downstream side in the feeding direction of the cover member and the sheet detecting means is defined at not more than the length of the sheet to be fed, and therefore when the sheet detecting means detects feeding of sheet by the second feeding means, the belt of the first feeding means is stopped immediately as mentioned above, so that the second and subsequent sheets are prevented from being fed in contact with the belt of the first feeding means.

Still more, in the invention, the sheet fed by the first feeding means is further fed by the second feeding means, and in this process when the time from start of feed of sheet by the first feeding means till expiration of the timer reaches a predetermined duration, the driving means of the first feeding means is stopped by the stopping means, thereby stopping the belt driving. In this ways, instead of actually installing sheet detecting means at the downstream side of the second feeding means, the time from start of feeding of sheet by the first feeding means till end of feed of the same sheet by the second feeding means is detected, and the operation by the stopping means may be thus controlled by using a timer, and the sheet detecting means is not necessary, so that the constitution may be simplified.

Also according to the invention, the cover member may be driven automatically in response to the output from the size determining means for determining the size of the sheet to be fed.

Moreover, by the invention, the constitution may be simplified by aligning the ends of the sheets stacked up on the laying plate at the upstream side in the feeding direction by means of the rear end defining member, and fixing the cover member to this rear end defining member. Incidentally, the second feeding means may be composed of a pair of rollers, so that the constitution may be also simplified.

BRIEF DESCRIPTION OF THE DRAWINGS

Other and further objects, features, and advantages of the invention will be more explicit from the following detailed description taken with reference to the drawings wherein:

FIGS. 1(1) and 1(2) are sectional views of prior art,

DETAILED DESCRIPTION OF THE PREFERRED EMBODIMENTS

Figure 2:
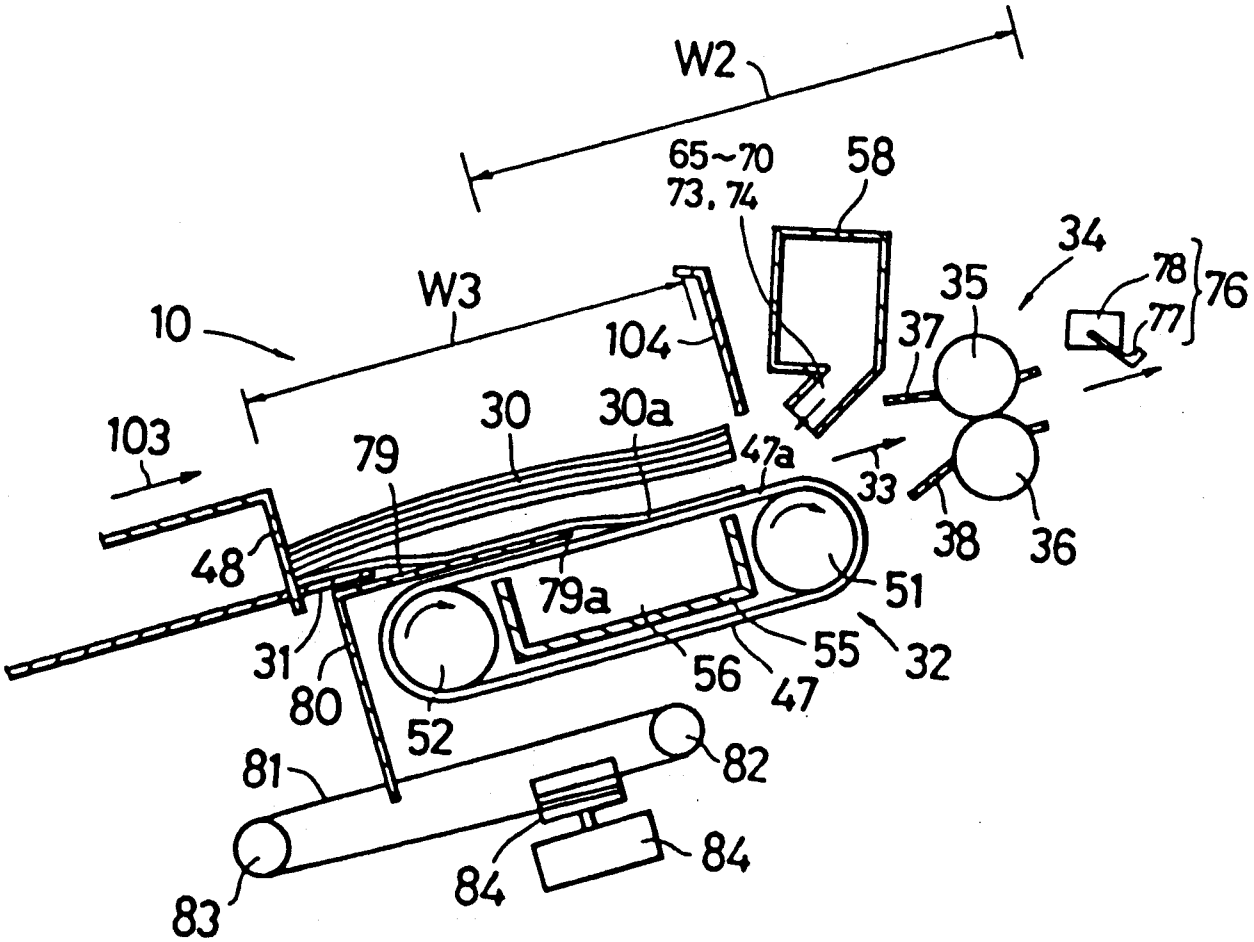
FIG. 2 is a sectional view of an embodiment of the invention.

Now referring to the drawing, preferred embodiments of the invention are described below.

FIG. 2 is a longitudinal sectional view of an embodiment of the invention. This recording paper feeding apparatus with duplicate feed preventive function 10 is used as a so-called intermediate tray 12 of a copying machine 11 shown in FIG. 3. The recording papers to be copied on are fed one by one from recording paper feeding means 13, and led into a transfer region 16 of a right-cylindrical photosensitive material 15 through a conveying route 14. A recirculating document handler 17 leads the document into a reading region 18, and the original image is focused on an exposure region 20 of the photosensitive material 16 by optical means 19, and an electrostatic latent image of the original is formed in the region of the photosensitive material 15 charged by main corona discharger 21. This electrostatic latent image is transformed into a sensible toner image by developing means 20, and is transferred on one side of the recording paper passing through the transfer region 16, and then fixed by fixing means 23. To copy also on the other side of the recording paper, the recording paper fixed on one side by the fixing means 23 is passed through the conveying route 24 and also through switchback route 25 to be once stacked up and deposited on the feeding device 12 of the invention which is an intermediate tray. From the feeding device 12, the recording paper is led again into the transfer region 16 through the conveying routes 26 and 14, and the other original is copied on the other side of the recording paper. The recording paper thus copied on both sides is fixed by the fixing means 23, and discharged into a tray 29 through discharge roller 28.

Figure 3:
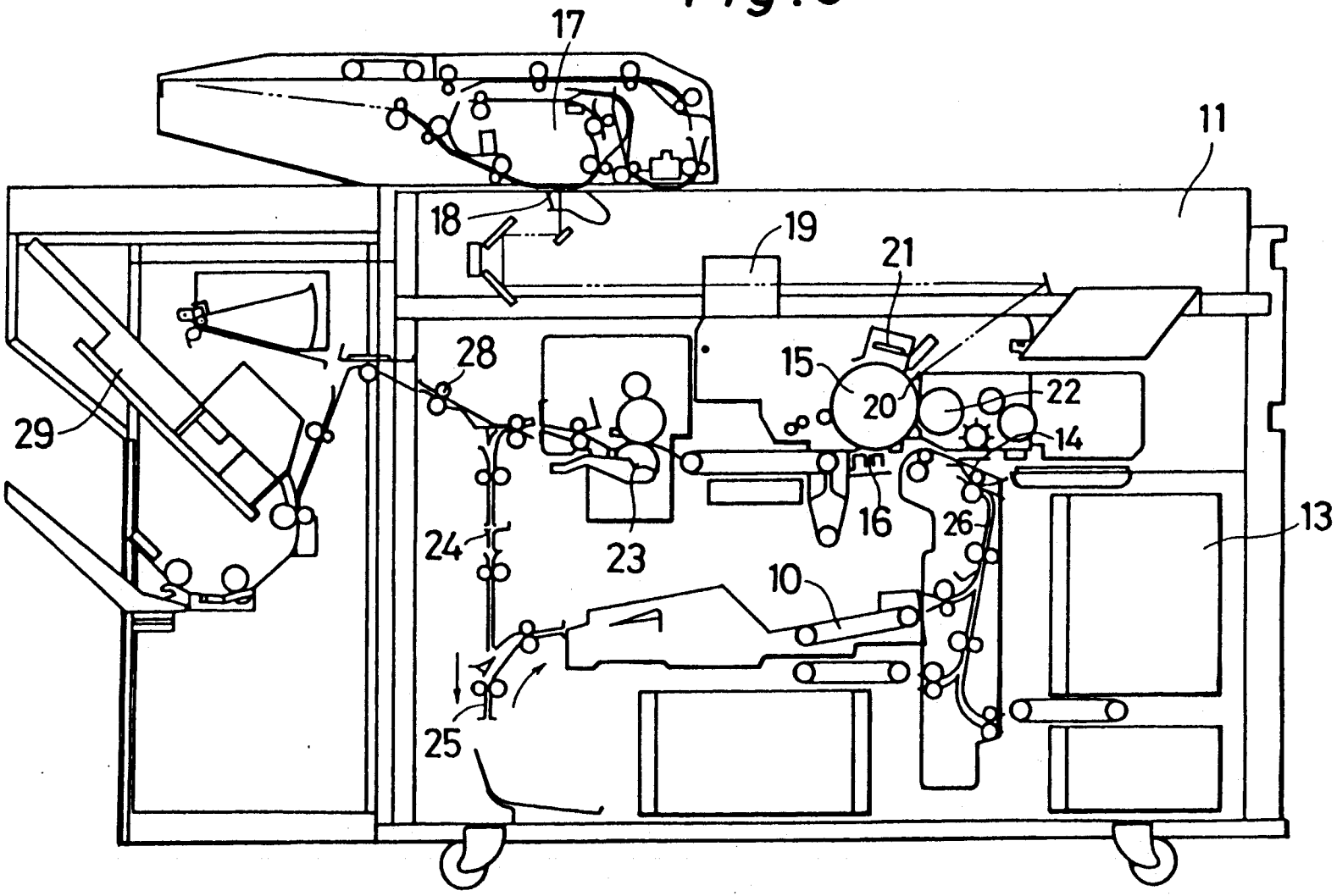
FIG. 3 is a simplified sectional view of copying machine 11 provided with feeding apparatus 10 shown in FIG. 2.
Figure 4:
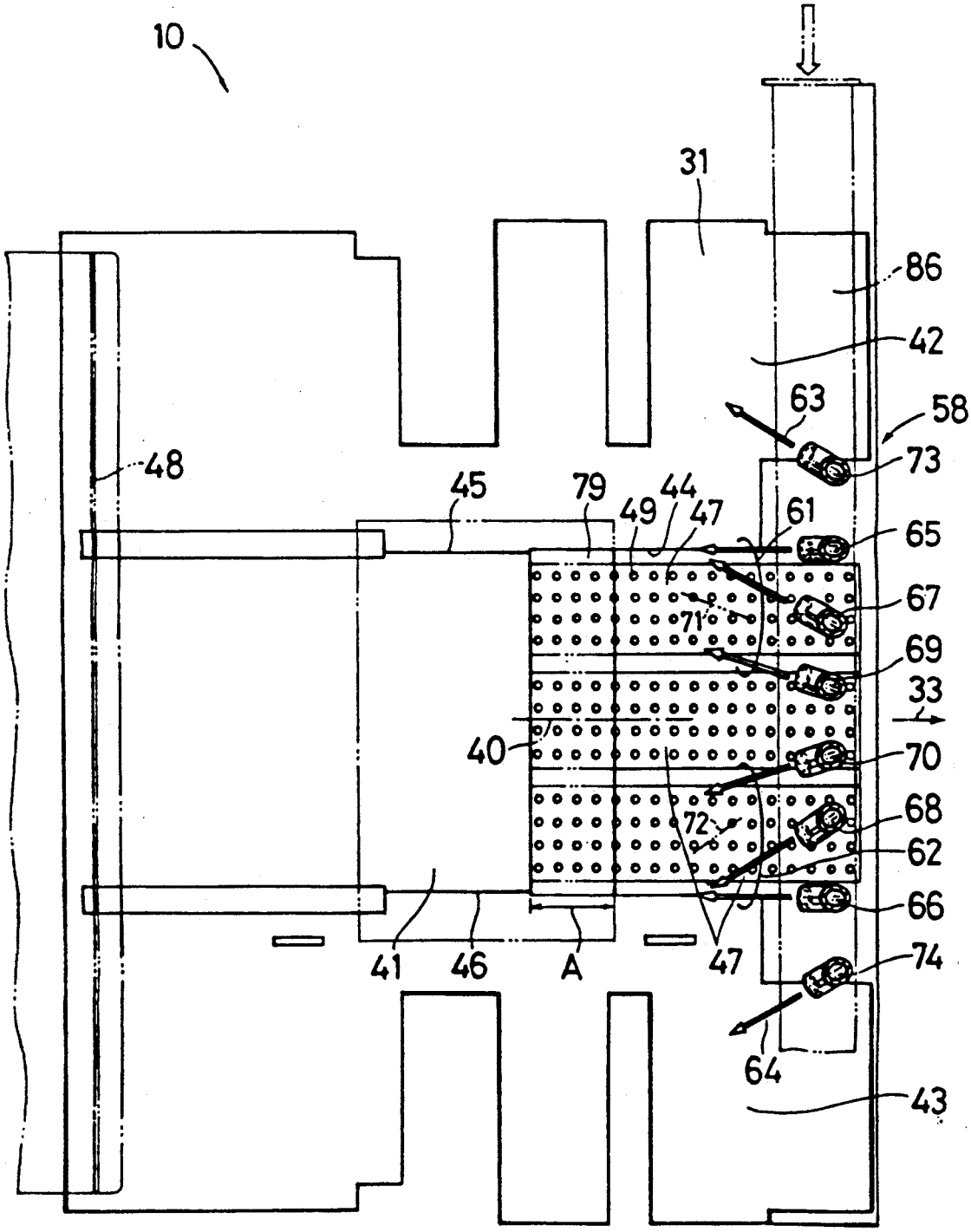
FIG. 4 is a plan view of feeding apparatus 10.
Figure 5:
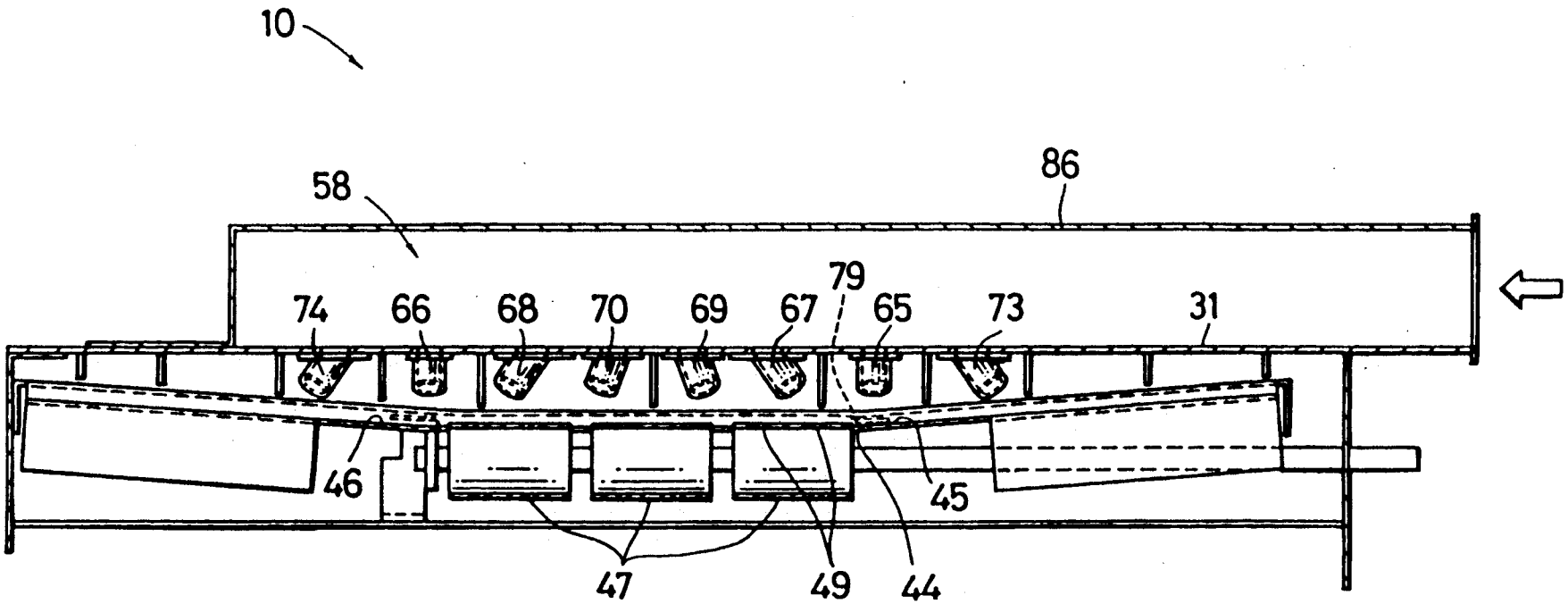
FIG. 5 is a front view of feeding apparatus 4.

FIG. 4 is a simplified plan view of the recording paper feeding apparatus 10, and FIG. 5 is a front view of the recording paper feeding apparatus 10 as seen from the feeding direction downstream side (that is, from the right side in FIG. 2 and FIG. 3). Referring to these drawings, the plural recording papers indicated by reference number 30 are stacked up on the laying plate 31. The first feeding means 32 feeds the bottom recording paper **30*a* of the recording papers 30 stacked up on the laying plate 31, in the feeding direction 33. At the downstream side (right side in FIG. 2 and FIG. 3) of the feeding direction 33 of the first feeding means 32 is disposed second feeding means 34 for further feeding the recording paper so far fed by the first feeding means 32. This second feeding means 34 comprises a pair of rollers 35, 36 for holding and feeding the recording paper being disposed in upper and lower positions, and guide members 37, 38** for guiding the recording paper.

The laying plate 31 is disposed symmetrically to symmetrical sides 40 passing through the central position in the widthwise direction (vertical direction in FIG. 4), and this laying plate 31 comprises a nearly horizontal central laying part 41, and side laying parts 42, 43 extending in both widthwise directions from the central laying part 41. A notch 44 is formed at the end part of the downstream side in the feeding direction of the central laying part 41. The first feeding means 32 is opposite to this notch 44. The side laying parts 42, 43 are inclined upward as going away from the central laying part 41 in both widthwise directions, and the boundaries 45, 46 of the central laying part 41 and side laying parts 42, 43 are parallel to the feeding direction 33.

The first feeding means 32 has plural (three in this embodiment) feeding stretch belts 47 disposed adjacently in the widthwise direction, and these belts 47 are endless, and their upper stretching parts **47*a* are a most horizontal, and are inclined, in this embodiment, upward as going to the downstream side of the feeding direction 33. The laying plate 31 is also inclined upward as going to the downstream side of the feeding direction 33, and the upper ends in the feeding direction of the recording papers 30 stacked up in this way are aligned as contacting against the rear end defining member 48. The belts 47 possess multiple air passage holes 49, and are extended in the feeding direction 33. These belts 47 are applied on rollers 51, 52 disposed at an internal before and after in the feeding direction, and these rollers 51, 52 are driven by a motor 53 explained below (see FIG. 9). Immediately beneath the upper stretching parts 47***a* of the belts 47, a vacuum attraction box 55 opened upward is disposed. This vacuum attraction box 55 is attracted by the fan, and the internal space 56 in the vacuum attraction box 55 is in a negative pressure, for example, −40 to 50 $mmH_2O$.

Figure 9:
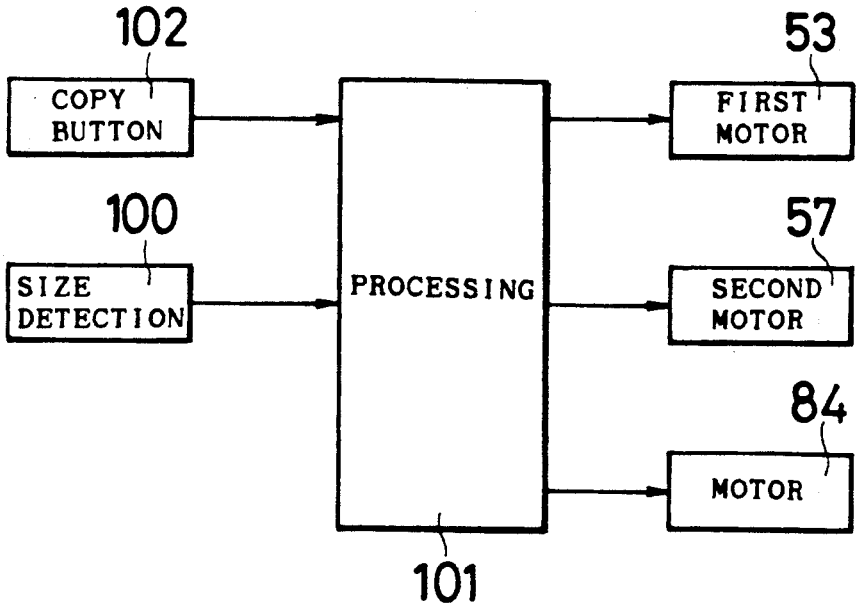
FIG. 9 is a block diagram showing electric composition of other embodiment of the invention.

The rollers 35, 36 of the second feeding means 34 are driven by a motor 57 (see FIG. 9). Separating the recording papers stacked up on the laying plate 31 vertically, in order to feed only the bottom recording paper 30*a*, air flow forming means 58 is disposed. This air flow forming means 58 is disposed at the downstream side of the feeding direction 33 of the laying plate 31, above the belts 47, and is intended to inject air flows 61, 62; 63, 64 from the right and left symmetrical positions on the symmetrical surface 42, toward the upper stretching parts 47*a* of the belts 47 of the first feeding means, and also toward the vicinity of the end part of the stacked-up recording papers 30, respectively. The air flows 61, 62 are flat in the widthwise direction of the laying plate 31, and plural (three in this example) nozzles 65, 66; 67, 68; 69, 70 are disposed symmetrically to the symmetrical surface 40, with respect to each one of the air flows 61, 62. The nozzles 67 to 70 shifted to the middle in the widthwise direction will inject air outward in the widthwise direction as going upstream (leftward in FIG. 4) in the feeding direction 33. The nozzles 65, 66 shifted outward in the widthwise direction will inject air parallel to the feeding direction 33. The nozzles 65, 66 are located near the boundaries 45, 46. The air injected from the nozzles 65 to 70 is indicated by thick arrows. In this way, the air flows 61, 62 are concentrated on the central lines 71, 72, and the concentrated air flow is inflated vertically within the stacked-up recording papers 30, so that the bottom recording paper 30*a* and the remaining recording papers are completely separated up and down. When the recording paper 30 is broad, air flows 63, 64 are injected from nozzles 73, 74, and the broad sheets can be separated up and down securely, together with the air flows 61, 62. Since the nozzles 65, 66 are located near the boundaries 45, 46, a gap is produced between the bottom recording paper 30*a* tightly attracted in vacuum to the upper stretching parts 47*a* of the belts 47 of the first feeding means 32, and the remaining recording papers not attracted in vacuum, near the boundaries 45, 46, and the concentrated air flows 61, 62 are blown into this gap, so that the vertical separation of the recording papers will be more secure.

At the downstream side of the second feeding means 34, there is sheet detecting means 76 for detecting the copying paper 30 fed by the second feeding means 34. This detecting means 76 is realized, for example, by a contact piece 77 contacting with the recording paper, and a microswitch 78 which changes in the switching mode depending on the angular displacement of the contact piece 77.

A cover member 79 is intervening between the laying plate 31 and the upper stretching parts 47*a* of the belts 47, and covers the region A (see FIG. 4) of the upstream side in the feeding direction 33 of the upper stretching parts 47*a* which are the feeding sides of the belts 47, so that the length of the region A in the feeding direction may be adjustable. A mounting piece 80 is fixed to the cover member 79, and this mounting piece 80 is coupled to a wire 81. The wire 81 is wound on pulleys 82, 83, and this wire 81 is wound on a pulley 85 which is driven by a pulse motor 84. As the pulse motor 84 is driven in this way, the cover member 79 is opposite to the notch 44 and covers the region A at the upstream side in the feeding direction of the upper stretching parts 47*a* of the belts 47.

The nozzles 65 to 70, 73, 74 are coupled to a duct 86 in which compressed air is supplied from the fan.

Figure 6:
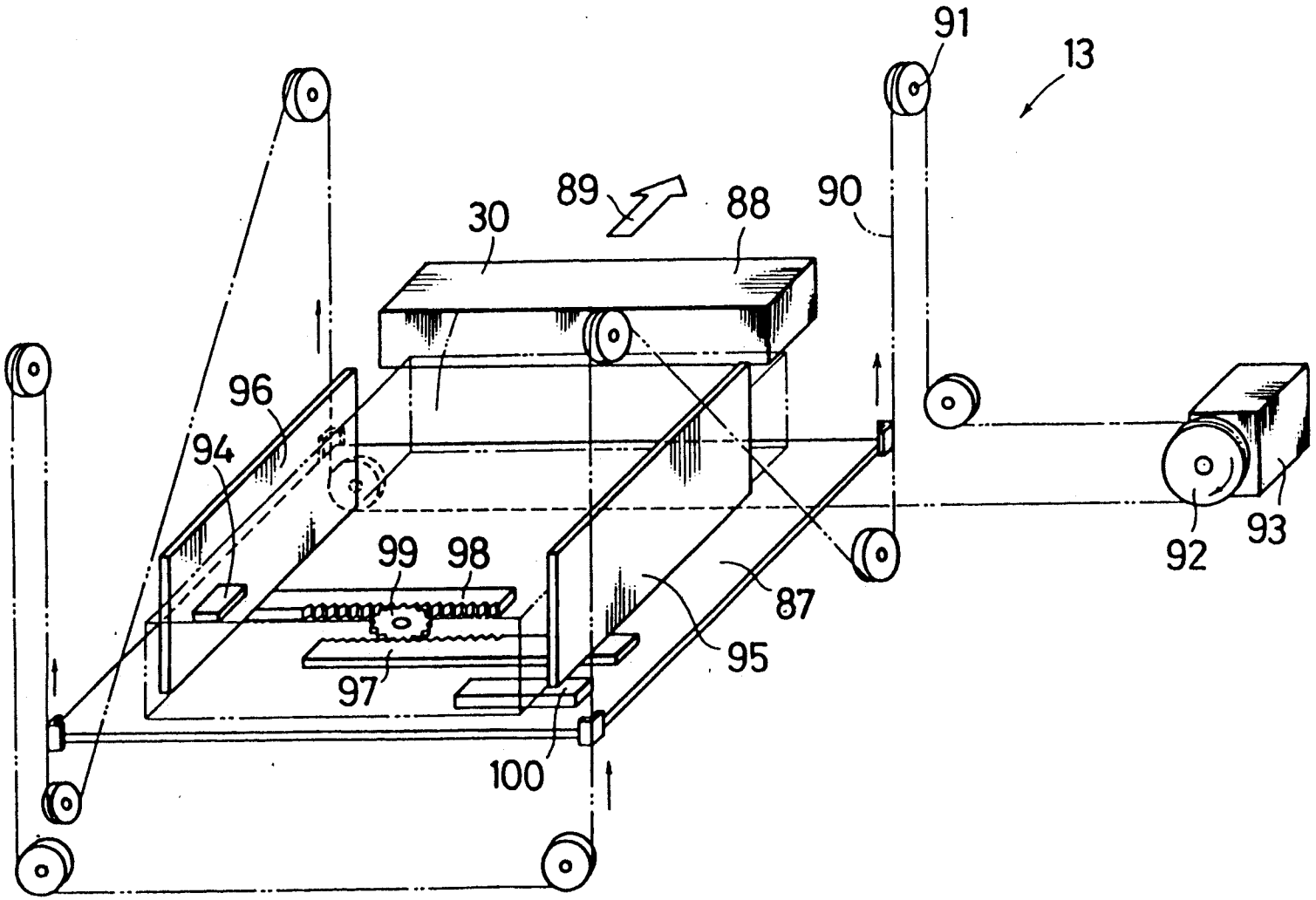
FIG. 6 is a partial perspective view of recording paper feeding means 13.

FIG. 6 is a simplified perspective view of the recording paper feeding means 13. The recording papers 30 are stacked up and put on a horizontal support plate 87, and the top recording paper is fed in the feeding direction 89 by feeding means 88, and is sent into the conveying route 14. This support plate 87 is coupled to a wire 90, and this wire 90 is wound on plural pulleys 91, and the pulleys 91 are coupled with another pulleys 92, and these pulleys 92 are driven by a motor 93. The position of the top recording paper of the stacked-up recording papers 30 is detected by a detector 94, and the motor 93 is driven so that the position of the top recording paper may be always specific. The both sides of the recording papers are aligned by a pair of lateral end defining plates 95, 96. Racks 97, 98 are affixed to these lateral end defining plates 95, 96, and these racks 97, 98 are engaged with pinions 99 rotatably disposed on the support plate 87. Therefore, the lateral end defining plates 95, 96 can feed with the widthwise central position of the recording papers 30 fixed at a predetermined position. The widthwise position of the lateral end defining plate 95 is detected by size detecting means 100. By this size detecting means 100, the width of the recording papers 30, therefore, the length in the feeding directions 33, 89 can be detected. The recording papers 30 are formatted in predetermined standard sizes, and therefore by detecting the width of the recording papers 30 by the detecting means 100 in this way, the length in the feeding direction will be known.

Figure 7:
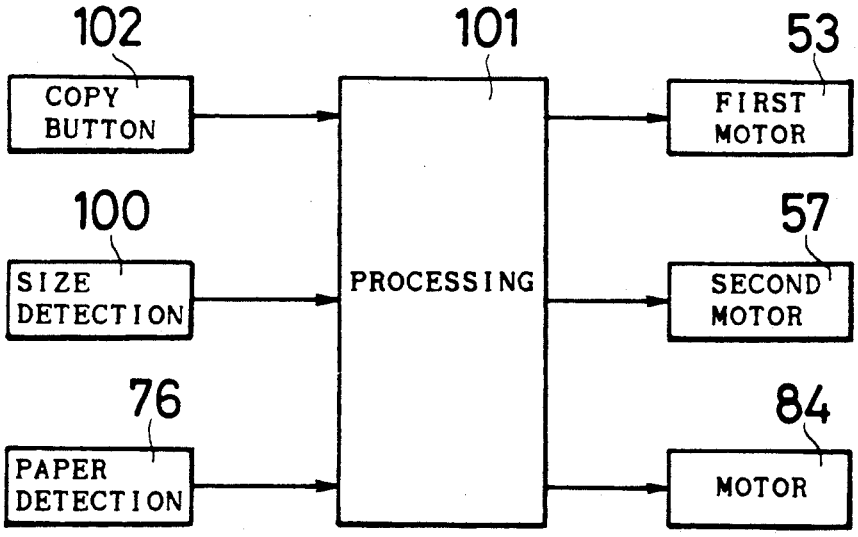
FIG. 7 is a block diagram showing electric composition of the embodiment shown in FIGS. 2 to 6.

FIG. 7 is a block diagram showing an electric composition of the embodiments shown in FIGS. 2 to 6. A processing circuit 101 is realized, for example, by microcomputer, and it responds to the output from recording paper detecting means 76 and size detecting means 100, and receives the output of a copy button 102 manipulated by the operator, and thereby controls motors 53, 57 of the first and second feeding means 32, 34, and also controls the motor 84 for driving the cover member 79.

Figure 8:
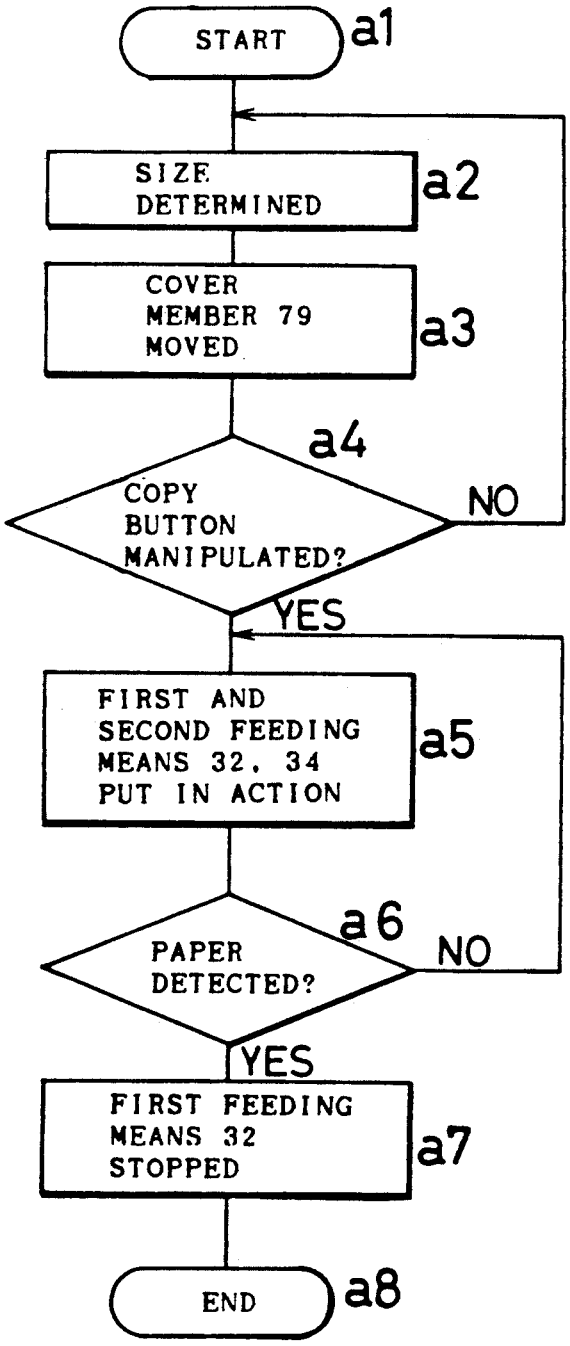
FIG. 8 is a flow chart for explaining the operation of processing circuit 101 shown in FIG. 7.

FIG. 8 is a flow chart for explaining the operation of the processing circuit 101 shown in FIG. 7. To copy on both sides of the recording paper from the recording paper feeding means 13, first the recording paper 30 copied on one side is sent into the feeding apparatus 10 as indicated by arrow 103 in FIG. 2, and collides against a collision plate 103, and is stacked up on the laying plate 31, cover member 79, and also on the upper stretching part 47*a* of the belt 47 of the first feeding means 32, and the rear ends of the recording papers 30 are aligned by the rear end defining member 48. In FIG. 8, going on from step a1 to step a2, the width of the recording paper 30 in the recording paper feeding means 13, hence its size, is detected and determined by the detecting means 100. As a result, the length of the recording paper 30 in the feeding directions 33, 89 will be known, and accordingly the motor 84 is driven, and the cover member 79 is adjusted as being driven and dislocated before and after the feeding direction 33.

When the copy button 102 is manipulated in this state, it is judged at step a4, and the operation is advanced to step a5. In consequence, the motors 53, 57 of the first and second feeding means 32, 34 are driven. Therefore, the bottom recording paper 30*a* of the stacked-up recording papers 30 is attracted in vacuum to the upper stretching part 47*a* of the belt 47, and separated up and down by the air flow from the air flow forming means 58, and the bottom recording paper 30*a* is fed to the downstream side of the feeding direction 33. This recording paper 30*a* is held by the rollers 35, 36, and is further supplied to the downstream side of the feeding direction 33. When it is judged at step a6 that the recording paper 30*a* held and fed by the rollers 35, 36 is detected by paper detecting means 76, the motor 53 of the first feeding means 32 is stopped, and the belt 47 is stopped, too. On the other hand, the motor 57 of the second feeding means 34 continues to be driven, and the recording paper 30*a* is held and fed by the rollers 35, 36.

According to the concept of the invention, the distance W2 in the feeding route between the end part 79*a* at the downstream side of the feeding direction 33 of the cover member 79 and the recording paper detecting means 76 is controlled to be not more than the length W3 of the recording papers 30 to be fed by driving the cover member 79 in response to the output from the size detecting means 100 by the motor 84 ($W2 \geqq W3$). Therefore, when the recording paper 30*a* fed by the rollers, 35, 36 is detected by the recording paper detecting means 76, the end part at the upstream side in the feeding direction of the recording paper 30*a* (that is, the rear end part) is either overlapped on the end part 79*a* of the cover member 79 or at the same position, and exactly at this moment the belt 47 is stopped. Therefore, the recording paper 30*a* is fed by the second feeding means 34, and if a gap is produced between the rear end part of the recording paper 30*a* and the end part 79*a* of the cover member 79 and the second recording paper from the bottom contacts with or approaches the upper stretching part 47*a* of the belt 47, since the belt 47 remains stopped as mentioned above, the second recording paper 30 is not fed, and is not deviated to the downstream side in the feeding direction, but is attracted in vacuum and stopped by the upper stretching part 47*a*. In this way, only one bottom recording paper 30*a* is fed.

As other embodiment of the invention, at step a2 in FIG. 8, the size of the recording paper may be directly fed into the processing circuit 101 by manipulating the input means such as key input means by the operator, and the cover member 79 is moved according to the signal fed from such input means.

FIG. 9 is a block diagram showing an electric composition of other embodiment of the invention. This embodiment is similar to the foregoing embodiments, and corresponding parts are identified with same reference numbers. In this embodiment, meanwhile, the recording paper detecting means 76 is omitted.

Figure 10:
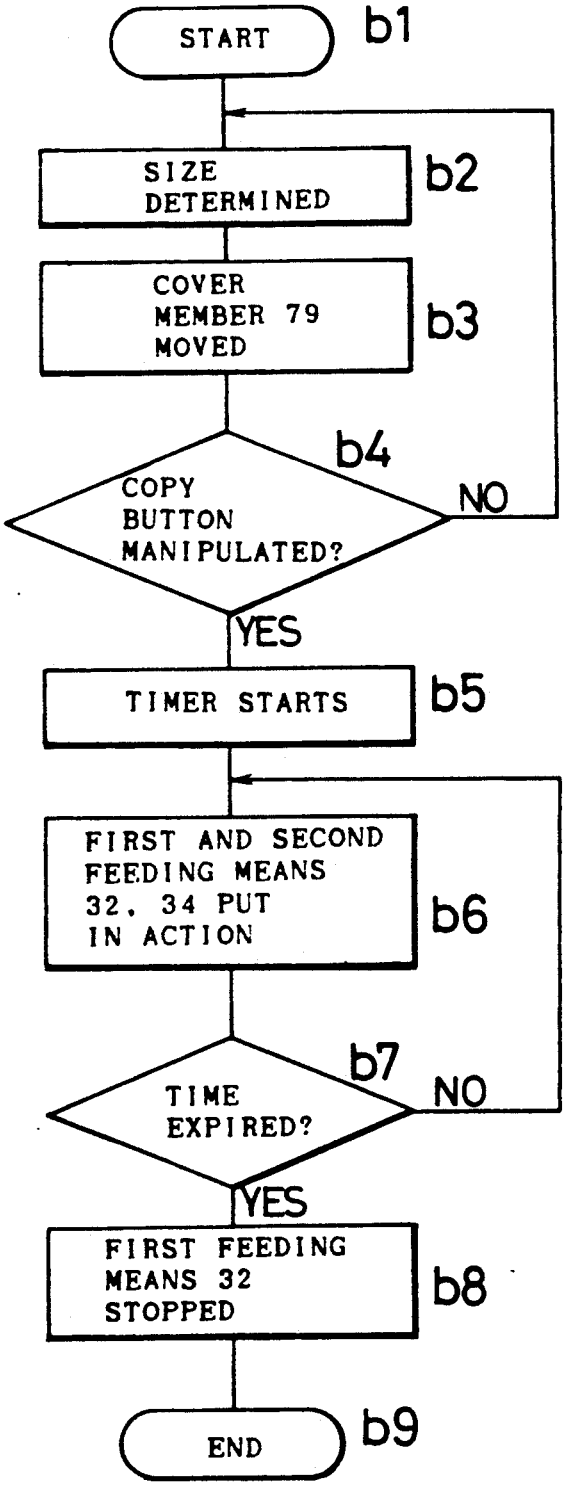
FIG. 10 is a flow chart for explaining the operation of processing circuit 101 of the embodiment shown in FIG. 9.

FIG. 10 is a flow chart for explaining the operation in the processing circuit 101 of the embodiment shown in FIG. 9. Steps b1 to b4 are same as steps a1 to a4 in FIG. 8, and the cover member 79 is moved in response to the output from the size detecting means 100, and the copy button 102 is manipulated in this state. Moving from step b4 to step b5, the copy button 102 is manipulated, and when reaching the time when the bottom recording paper 30*a* is to be fed by the first feeding means 32, the timer installed in the processing circuit 101 starts clocking the time at step b5. At step b6, the motors 53, 57 of the first and second feeding means 32, 34 are driven, and the bottom recording paper 30*a* is fed from the first feeding means 32, and is held and fed by the rollers 35, 36 of the second feeding means 34. In the timer, a predetermined time is set, and when it is judged at step b7 that the time of the recording paper 30*a* being held and fed by the rollers 35, 36 has expired, the motor 53 of the first feeding means 32 is stopped by the processing circuit 101 at step b8. In this way, the first and second feeding means 32, 34 start feeding action, and the rear end of the bottom recording paper 30*a* is overlapped with the end part 79*a* of the cover member 79 or at the same position approximately, and at this time the belt 47 is stopped, and the second sheet is prevented from being fed by the upper stretching part 47*a* of the belt 47. Thus, only the bottom recording paper 30*a* is fed.

Figure 11:
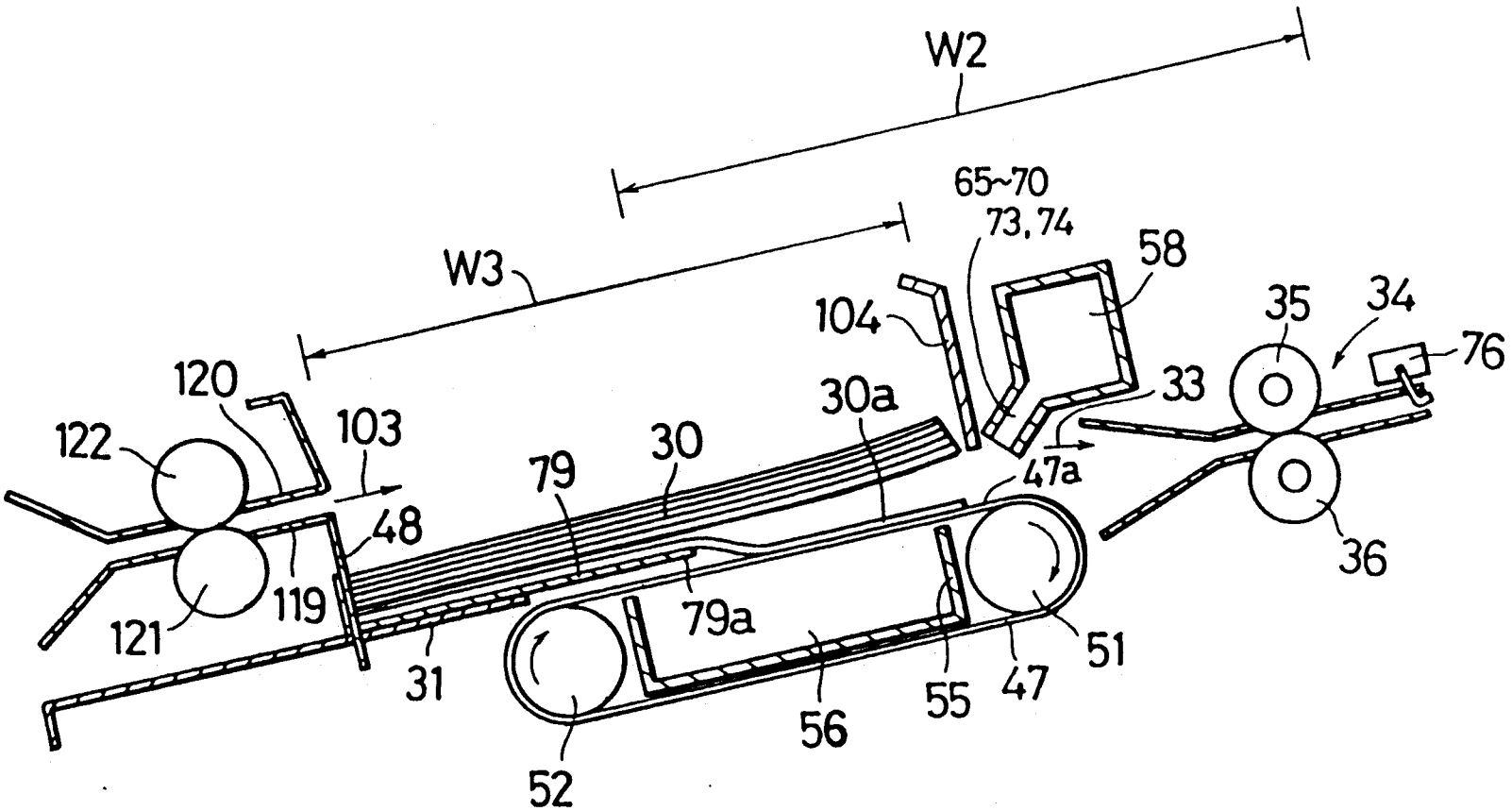
FIG. 11 is a simplified sectional view of a different embodiment of the invention.
Figure 12:
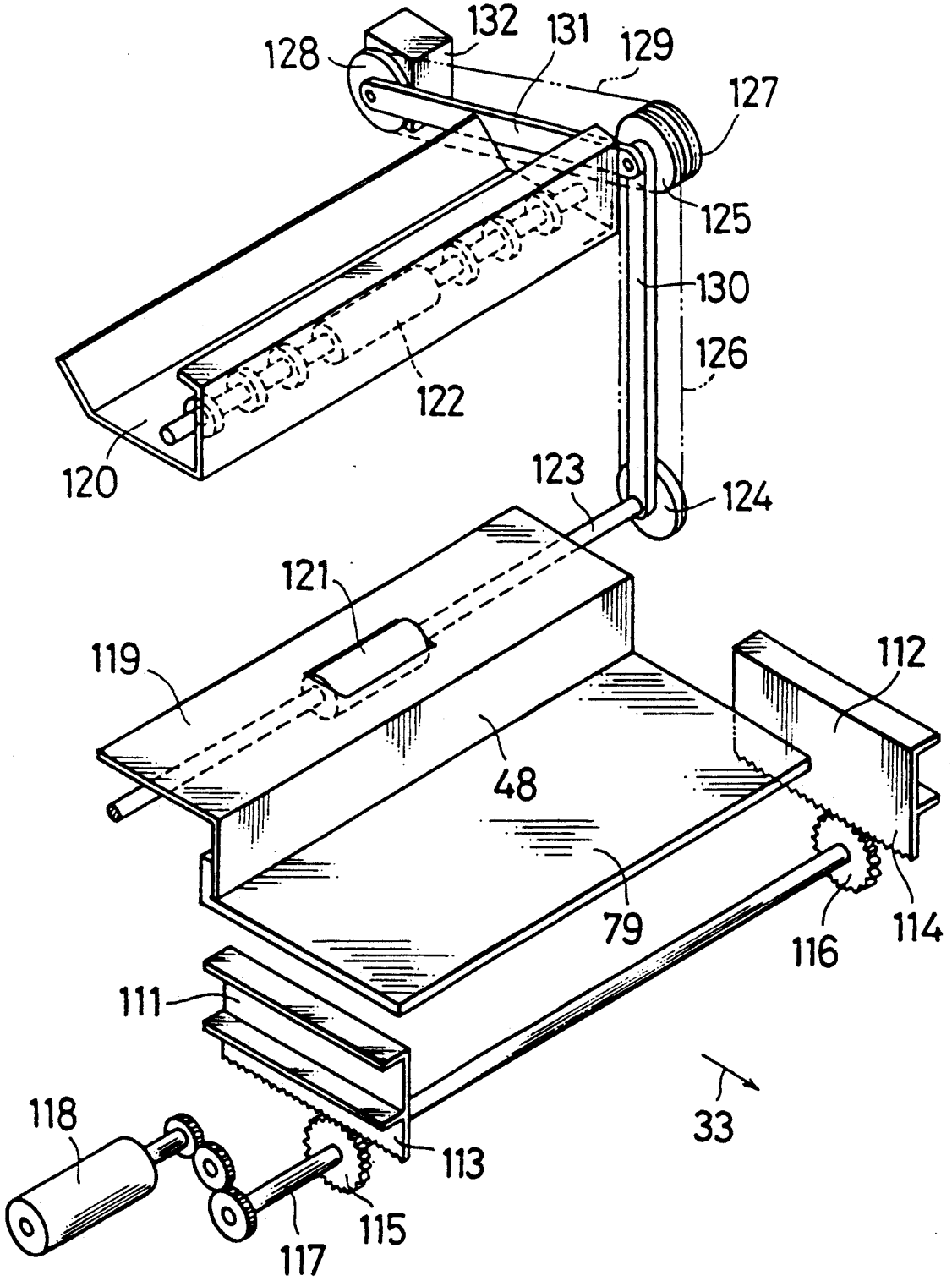
FIG. 12 is a simplified perspective exploded view of the embodiment in FIG. 11.

FIG. 11 is a simplified sectional view of an embodiment of the invention, and FIG. 12 is a simplified perspective exploded view of the same embodiment. This embodiment is similar to the foregoing embodiments, and corresponding parts are identified with same reference numbers. In this embodiment, the rear end defining member 48 is affixed to the cover member 79, and these members 48, 79 are designed to movable longitudinally in the feeding direction 33. The rear end defining member 48 is fixed to the support members 111, 112, and racks 113, 114 are formed on these support members 111, 112, and these racks are engaged with pinions 115, 116. The pinions 115, 116 are fixed to a shaft 117, and are driven by a motor 118. Thus, the rear end defining member 48 may be dislocated longitudinally in the feeding direction 33.

The rear end defining member 48 is furnished with a lower guide member 119 and an upper guide member 120 for guiding the recording papers 30 to be stacked up. From the lower guide member 119, a roller 121 is projecting, and from the upper guide member 120, a roller 122 is projecting to contact opposedly with the roller 121. The roller 122 is compressed by the spring force of the roller 121, and the recording paper 30 held between the rollers 121, 122 is sent into the direction of arrow 103. In order to rotate and drive the roller 121, a pulley 121 is fixed on a rotary shaft 123 which is fixed to this roller 121, and a belt 126 is applied between it and another pulley 125, and a belt 129 is applied between a pulley 127 which is integral with the pulley 215 and other pulley 128. The pulleys 124, 125; 127, 128 are supported by links 130, 131, and the pulley 128 is rotated and driven by a motor 132, and is rotatably arranged at a fixed position. Therefore, when the support members 111, 112, rear end defining member 48, cover member 79, guide members 119 and roller 121 are moved before and after in the feeding direction 33 by the motor 118, the mutual angle of the links 130, 131 is changed, and this dislocation is allowed, and the roller 121 is rotated and driven by the power of the motor 132.

In such embodiment, the motor 118 may be replaced by the motor 84 in the foregoing embodiment, and by the processing circuit 101 responding to the output of the size detecting means 100, same as in the foregoing embodiments, the rear end defining member 48 and the cover member 79 are driven in assembly, thereby defining the relation of $W2 \geqq W3$.

In this embodiment, too, the recording papers 30 are separated vertically by the air flow forming means 58.

Figure 13:
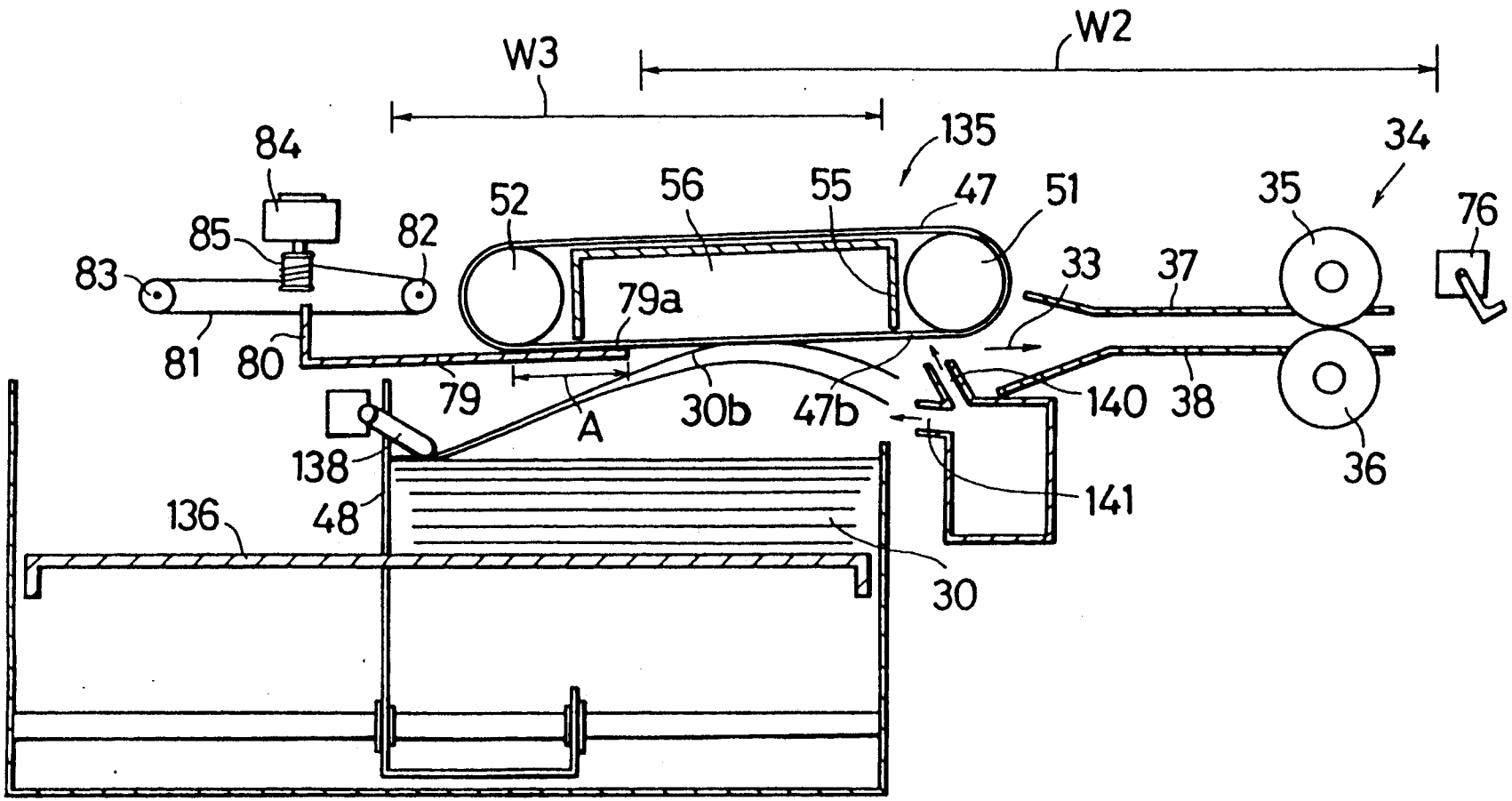
FIG. 13 is a sectional view of another embodiment of the invention.

FIG. 13 is a sectional view of other embodiment of the invention. This embodiment is partly similar to the preceding embodiments, but what is of note in this embodiment is that the first feeding means 153 is disposed at a higher position than the sheets 30 on the laying plate 136. The first feeding means 135 possesses multiple air passage holes, and an endless feeding stretch belt 47 extending along the feeding direction 33 is applied between the rollers 51 and 52, and a vacuum attraction box 55 is provided same as in the preceding embodiments. This vacuum attraction box 55 is located immediately above the nearly horizontal lower stretching part 47*b* of the belt 47, and is open downward. The cover member 79 covers the region A at the upstream side of the feeding direction 33 of the lower stretching part 47*b* forming the feeding surface of the belt 47, so that the length of the region A in the feeding, direction 33 may be adjustable, and is installed movably before and after in the feeding direction 33. This cover member 79 is driven and displaced by the motor 84, same as in the foregoing embodiments.

The top recording paper 30*b* of the recording papers 30 stacked up on the laying plate 136 is detected by the detecting means 138, and in the constitution similar to that in FIG. 6, the position of the top recording paper 30*b* is held at a specific position. The other constitution is similar to the embodiments disclosed in FIGS. 2 to 8.

In order to separate vertically the recording papers 30 stacked up on the laying plate 36 and attract only the top recording paper 30*b* in vacuum to the lower stretching part 47*b* of the belt 47, a nozzle 140 is provided to blow an air flow, and a lifting nozzle 141 is disposed so as to lift the stacked recording papers 30 by air. The air flow forming nozzle 140 is composed same as the foregoing air flow forming means 58.

Figure 14:
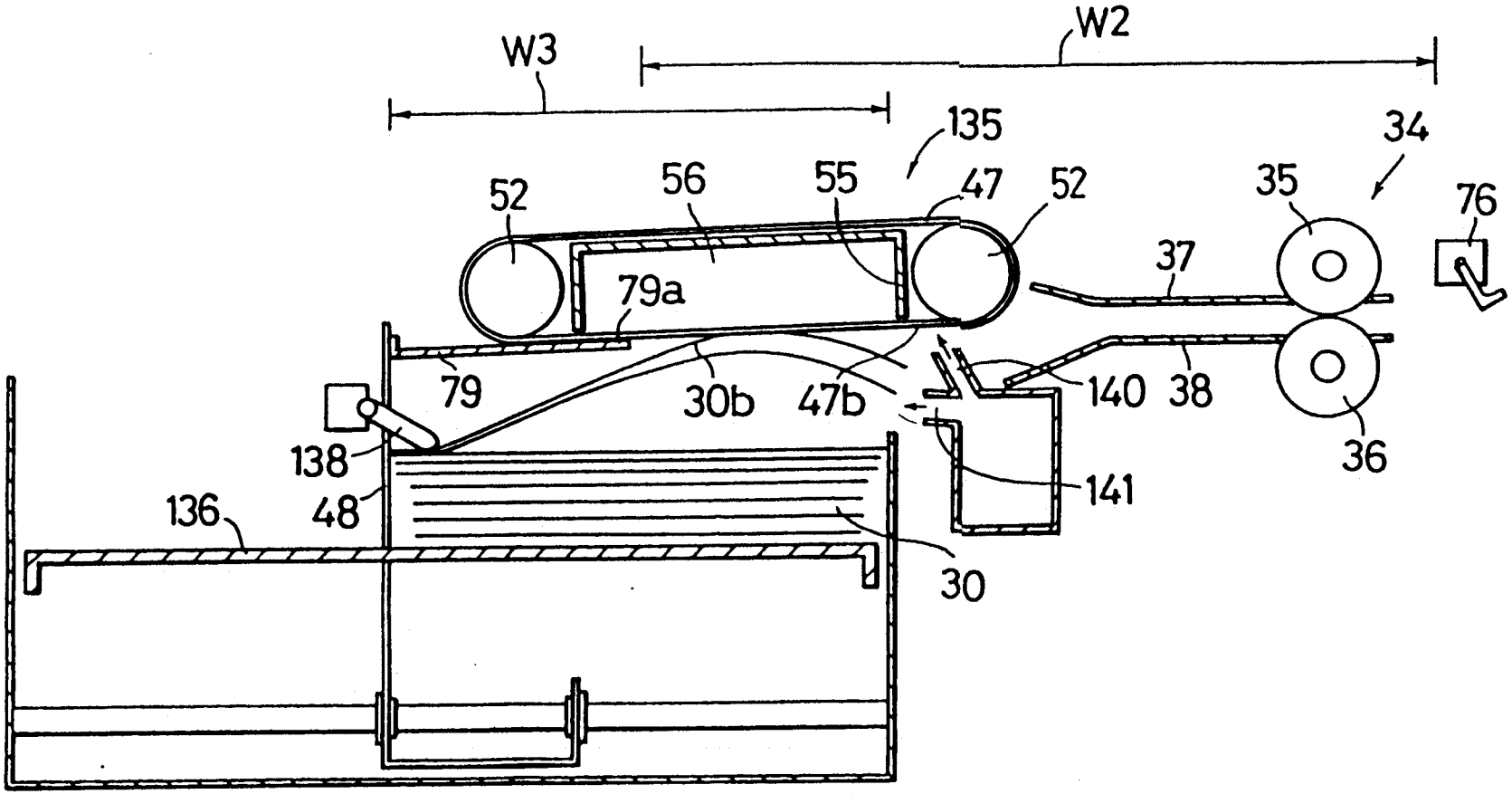
FIG. 14 is a sectional view of another different embodiment of the invention.

FIG. 14 is a sectional view of a different embodiment of the invention. This embodiment is similar to the foregoing embodiments. Especially in this embodiment, the cover member 79 is fixed to the rear end defining member 48, and the cover member 79 is dislocated depending on the dislocation of the rear end defining member 48. The other constitution is similar to the embodiment in FIG. 13, and corresponding parts are identified with same reference numbers.

Figure 15:
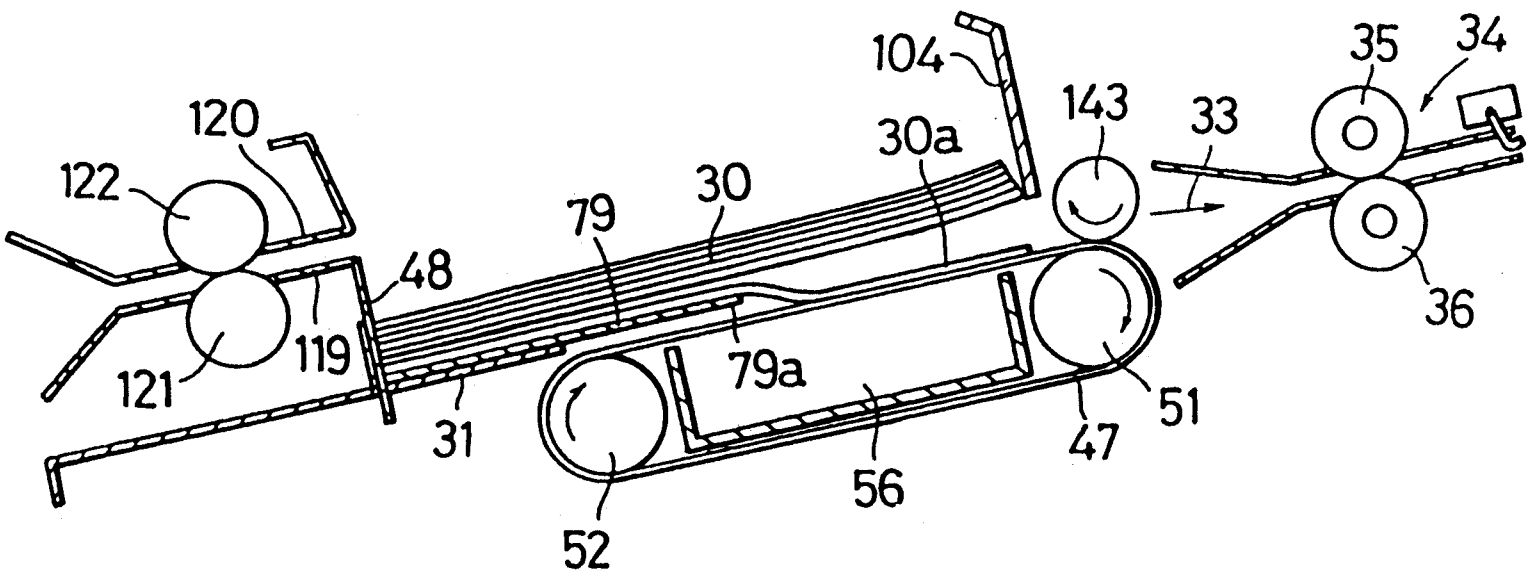
FIG. 15 is a sectional view of a still different embodiment of the invention.

FIG. 15 is a sectional view of a further different embodiment of the invention. In this embodiment, instead of the air flow forming means 58 in the embodiments shown in FIGS. 2 to 8, a duplicate feed preventive roller 143 is installed in order to feed only the bottom recording paper 30 securely, and by this roller 143, the second and other recording papers about to be fed on the bottom recording paper 30*a* are returned to the upstream side in the feeding direction 33.

Figure 16:
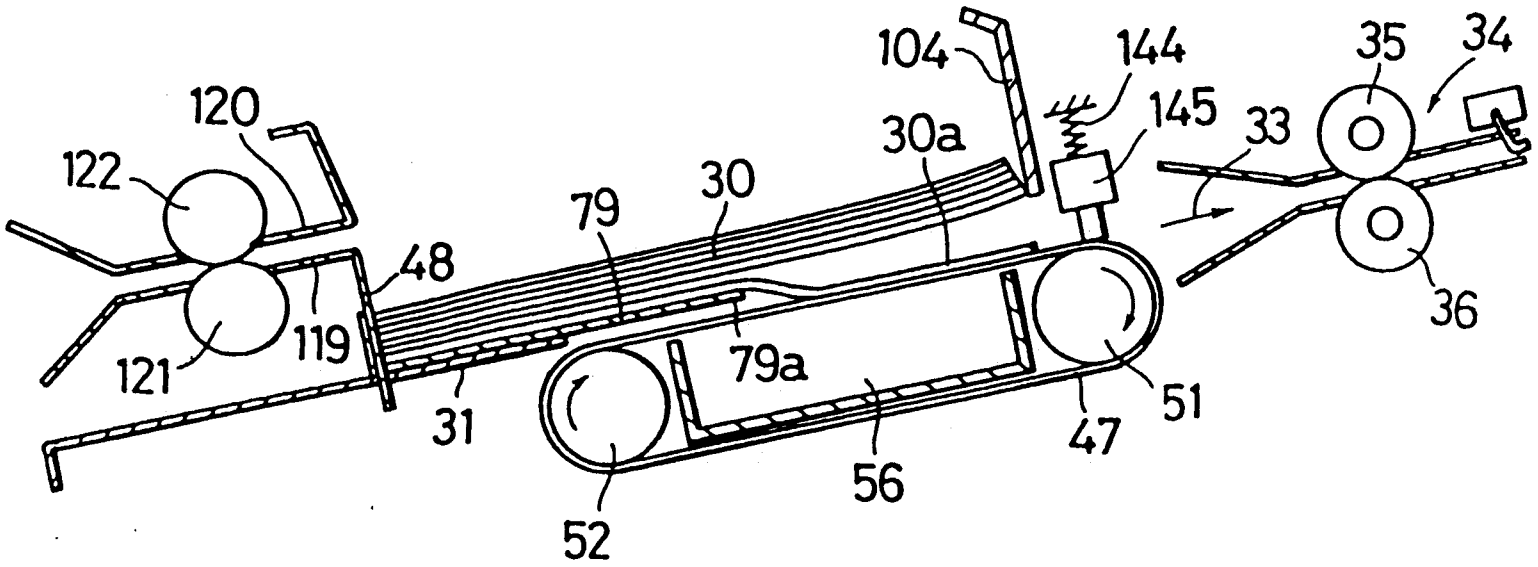
FIG. 16 is a sectional view of a further different embodiment of the invention.

FIG. 16 is a sectional view of another embodiment of the invention. This embodiment is also similar to the embodiments disclosed in FIGS. 2 to 8, except that a friction pad 145 being forced by a spring 144 is disposed, instead of the air flow forming means 58, in order to prevent feeding of second and subsequent sheets.

Incidentally, the belt used in the first feeding means may be designed to attract in vacuum as in the foregoing embodiments, but in a different embodiment multiple fine undulations may be formed on the outer circumference of the belt so as to increase the coefficient of friction to the sheet to be fed, and therefore the vacuum attraction box is not needed, and the constitution may be reduced in size.

Figure 17:
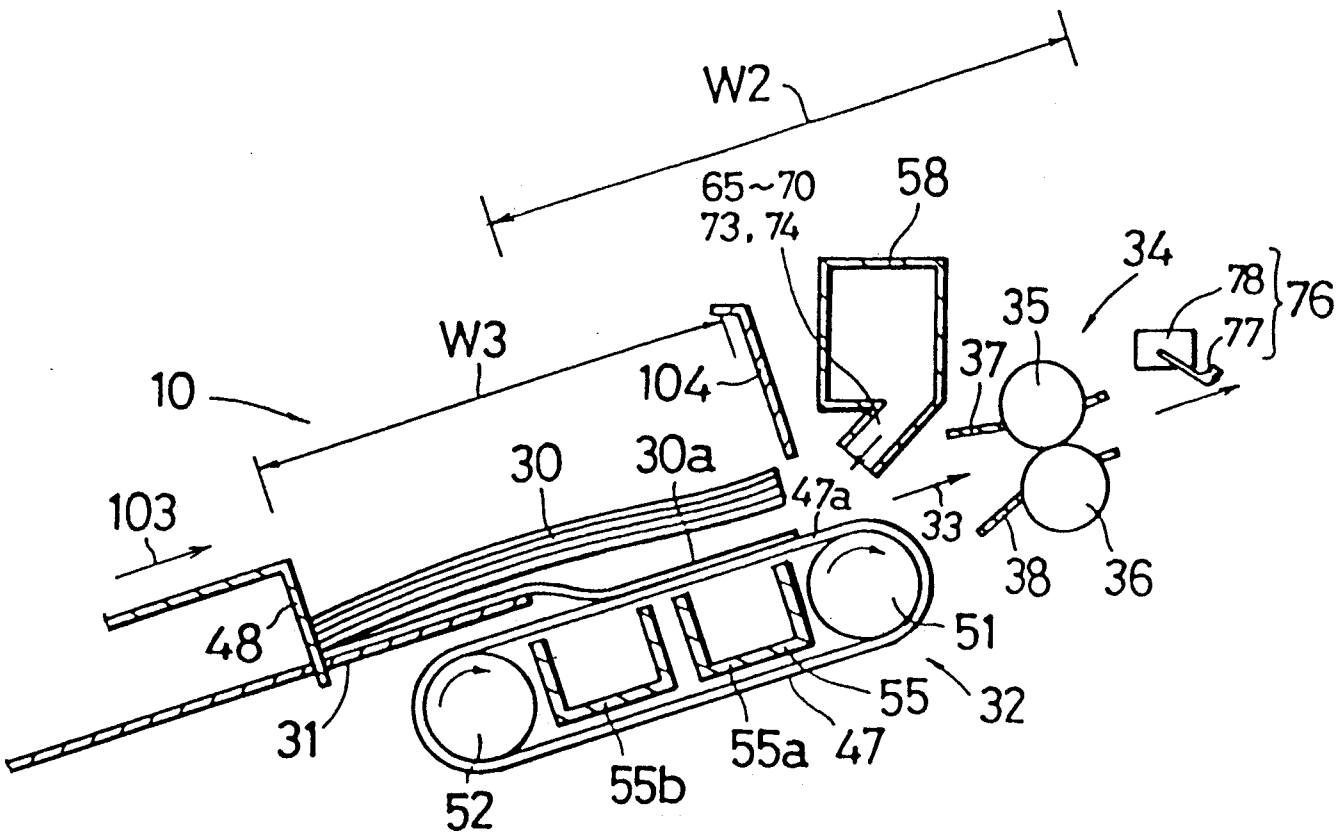
FIG. 17 is a sectional view of a still further different embodiment of the invention.

FIG. 17 is a sectional view of another different embodiment of the invention. In this invention, a plurality of (two in this embodiment) vacuum attraction box are disposed, as indicated by reference numbers 55*a*, 55*b*, toward the feeding direction 33.

Figure 18:
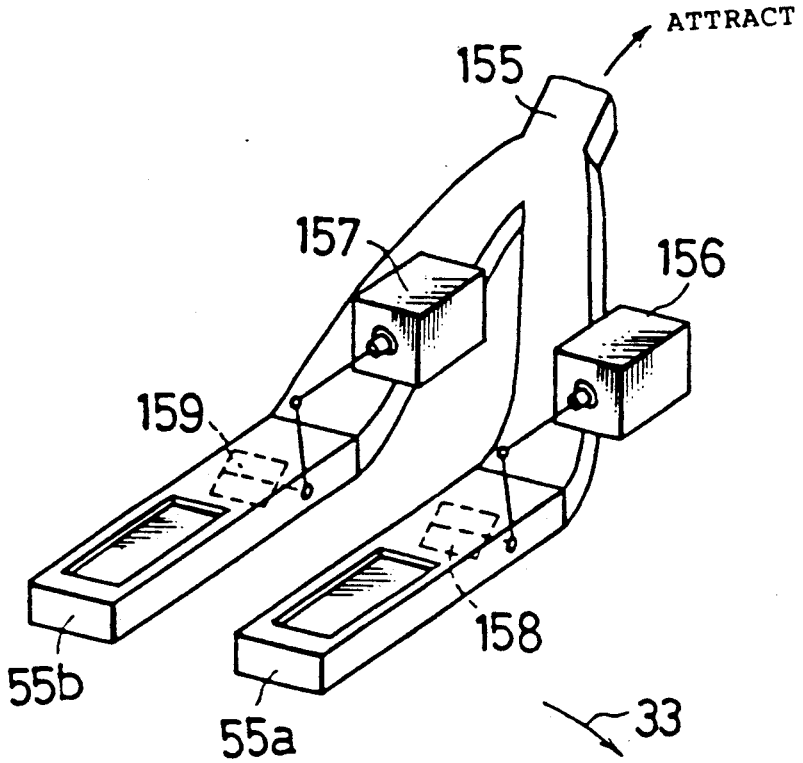
FIG. 18 is a perspective view of a part of the embodiment shown in FIG. 17.

FIG. 18 is a partial perspective view of the embodiment shown in FIG. 17. Air is supplied from a duct 155 into the vacuum attraction boxes 55*a*, 55*b*, and valves 185, 189 oscillated by electromagnetic solenoids 156, 157 are dislocated angularly, and the air is supplied selectively into the vacuum attraction boxes 55*a*, 55*b*. When the length of the recording paper 30 in the feeding direction is short, only the valve 158 is opened, and the valve 159 is closed, and vacuum attraction is effected thus only by the vacuum attraction box 55*a*. When the length of the recording paper 30 in the feeding direction is long, both valves 158, 159 are open, and the vacuum attraction is effected by both vacuum attraction boxes 55*a*, 55*b*. By excitation or deexcitation of the electromagnetic solenoids 156, 157, the valves 158, 159 are dislocated angularly and opened and closed. Such embodiment is also included in the true spirit of the invention.

The invention may be executed not only for feeding of recording papers of copying machine, but also in a wide scope for feeding recording papers of a printer or feeding other sheets than recording papers.

The invention may be easily modified by those skilled in the art in a scope not departing from the scope and true spirit of the claims thereof, and such changes and modifications shall be also included in the scope of the invention.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes, which come within the meaning and the range of equivalency of the claims are therefore intended to be embraced therein.

What is claimed is:

1. A sheet feeding apparatus comprising:

(a) a laying plate for receiving a stack of a plurality of sheets, (b) first feeding means for feeding a sheet to be fed from the stack, the feeding means located adjacent to the sheet to be fed, and downstream in a feeding direction from the laying plate, the first feeding means comprising:

(i) a feeding stretch belt for receiving the sheet to be fed and for providing the feeding surface, the belt extending downstream from the laying plate and (ii) means for driving the belt operatively connected to the belt, (c) a second feeding means for receiving individual sheets from the first feeding means, the second feeding means being downstream from the first feeding means, (d) a stopping means for stopping the means for driving the belt, (e) a cover member, covering an upstream region of the feeding surface, the region being adjustable lengthwise in the feeding direction of the feeding surface of the belt of the first feeding means so as to be able to adjust the length of the region in the feed direction, (f) means for providing activation of the stopping means comprising a timer for providing an output based upon a predetermined time interval from the start of feeding of a first sheet to be feed from the stack of sheets by the first feeding means until the end of feeding of the same sheet by the second feeding means and whereby the stopping means stops the driving means of the first feeding means in response to the output of the timer and the predetermined time is based upon the length of the sheet whereby a simultaneous feed of a plurality of sheets by the belt is prevented.

2. A sheet feeding apparatus according to claim 1 comprising:

an end portion of the laying plate that is downstream in the feeding direction contains a notch, and the notch opposes the first feeding means.

3. A sheet feeding apparatus according to claim 2 comprising:

the first feeding means comprises an endless feeding belt having multiple air passage holes and having an upper portion located beneath a lowermost sheet in the stack of sheets and a vacuum attracting box having openings facing upwardly, which box is disposed immediately beneath the upper portion of the belt.

4. A sheet feeding apparatus according to claim 1 comprising:

the first feeding means comprises an endless feeding belt having multiple air passage holes and having a lower portion located above an uppermost sheet in the stack of sheets and a vacuum attracting box having openings facing downwardly, which box is disposed immediately above the lower portion of the belt.

5. A sheet feeding apparatus according to claim 2 or 4, comprising:

an air stream forming means for injecting an air flow means and in a direction toward the positions of sheets in the laying plate, the air forming means being disposed downstream from the laying plate in the feeding direction.

6. A sheet feeding apparatus according to claim 1 comprising driving means for driving the cover member by reciprocal displacement along the feeding means, means for determining size of an outermost sheet being fed, and control means for activating the driving means for the cover member in response to the output of the size determining means, and setting the position of the cover member in the feeding direction while the outermost sheet to be fed from the stack of sheets is being fed by the first feeding means.

7. A sheet feeding apparatus according to claim 1 comprising a rear end defining member for aligning the sheets at the upstream side in the feeding direction, the rear end defining member being movable longitudinally in the feeding direction, and fixed on the cover member.

8. A sheet feeding apparatus according to claim 1 comprising the second feeding means comprises a pair of rollers for holding and feeding sheets.

* * * * *